US007112734B2

(12) United States Patent
Richter

(10) Patent No.: US 7,112,734 B2
(45) Date of Patent: Sep. 26, 2006

(54) EFFECTS OF FLOW IMPROVEMENT IN TAPERED DESIGN

(76) Inventor: Jacob Richter, 8 Anafa Street, Ramat Hasharon (IL) 47226

( * ) Notice: Subject to any disclaimer, the term of this patent is extended or adjusted under 35 U.S.C. 154(b) by 266 days.

(21) Appl. No.: 10/809,620

(22) Filed: Mar. 24, 2004

(65) Prior Publication Data

US 2004/0255754 A1 Dec. 23, 2004

(51) Int. Cl.
*G10D 3/02* (2006.01)

(52) U.S. Cl. ..... 84/384

(58) Field of Classification Search ..... 84/384, 84/380 R, 385 A

See application file for complete search history.

(56) References Cited

U.S. PATENT DOCUMENTS 3,685,388 A * 8/1972 Young ..... 84/384
4,685,373 A * 8/1987 Novo ..... 84/464 A
5,309,806 A * 5/1994 Stavash ..... 84/380 R

* cited by examiner

*Primary Examiner*—Kimberly Lockett
(74) *Attorney, Agent, or Firm*—Morgan & Finnegan, LLP

(57) ABSTRACT

The present invention is directed to an improved flute-type instrument having a reduced bore diameter in the head section, a conical bore in the intermediate section and a standard sized bore diameter in the main section. The reduced bore diameter in the head section is dimensioned to closely correspond to the circumferential diameter of the mouth hole opening to promote laminar-like flow of air through the mouth opening and into the head section bore.

13 Claims, 2 Drawing Sheets

Prior Art

EFFECTS OF FLOW IMPROVEMENT IN TAPERED DESIGN

FIELD OF THE INVENTION

The present invention relates to musical wind instruments, and in particular to improvements in the head section of flute-type wind instruments. As used herein, the term "flute-type" is intended to include all musical instruments of the flute family, such as flutes, alto flutes, bass flutes, piccolos, fifes and the like.

BACKGROUND OF THE INVENTION

Flute-type wind instruments generally consist of a cylindrical tube having a central bore extending therethrough. The cylindrical tube includes a head section having a side hole mouth opening over which air is blown to produce a tone, and a main body section having a series of toneholes to play a range of notes.

The central bore extending through the head section and the side hole mouth opening have a critical effect on the quality of the tone produced by flute-type wind instruments. The primary source of the degradation of tone quality, commonly referred to as the "hissing sound," is generated in the head section of flute-type instruments. The "hissing sound" results for the most part from the generation of turbulent flow in the central bore of the head section in the vicinity of the mouth opening.

This undesirable turbulent flow is created in part by the sharp change in the cross-sectional area of the flow path of air blown through the mouth opening and into the portion of the central bore in the head section of the instrument. The cross sectional area of the central bore in the head section of a conventional flute-type wind instrument is about four times larger than the cross sectional area of the mouth opening. The air undergoes an expansion as it flows into the central bore causing non-laminar or turbulent flow in the central bore.

SUMMARY OF THE INVENTION

An object of the present invention is to provide a flute-type instrument which is capable of providing a clear, rich, high quality sound and tone while overcoming the above-described problems.

To achieve this end, it is a principle object of the present invention to provide a flute-type instrument with a bore in the head section having a reduced diameter relative to the bore in the main section.

It is a further object of the present invention to provide a flute-type instrument wherein the ratio of the diameter of the bore in the head section and the circumferential diameter of the mouth opening is about 1.5 to 1 or less.

It is a further object of the present invention to provide a flute-type wind instrument with an intermediate section having a bore with a varied diameter that gradually increases from a first end adjacent to and aligned with the bore in the head section to a second end adjacent to and aligned with the bore in the main section of the instrument.

These aspects and other objects, features, and advantages of the present invention are described in the following Detailed Description which is to be read in conjunction with the accompanying drawings.

DETAILED DESCRIPTION

Figure 1:
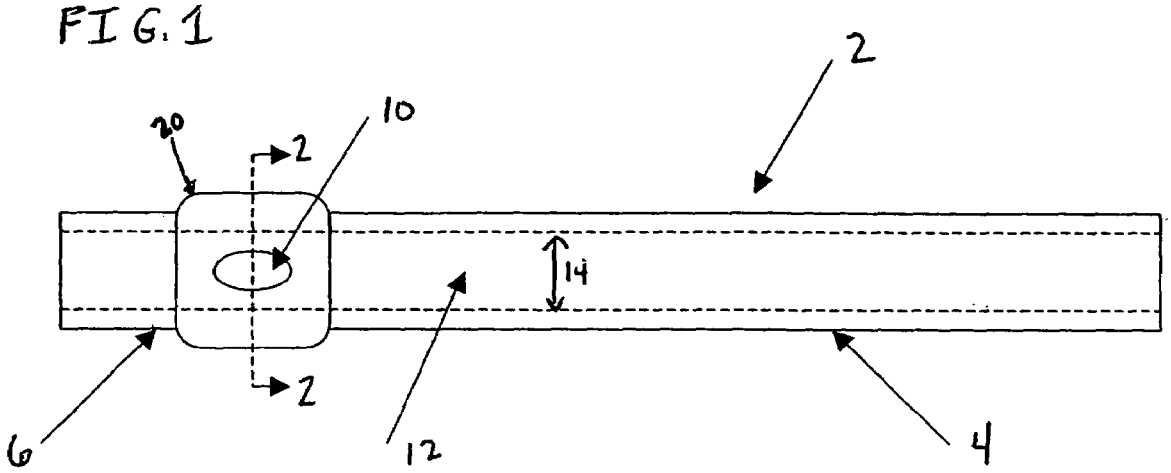
FIG. 1 is a perspective view of a conventional flute-type wind instrument.

FIG. 1 illustrates a conventional flute 2 having a main section 4 and a head section 6. The head section includes a mouth opening 10 over which air is blown to produce a tone. The mouth opening 10 is typically oval or elliptical in shape. Standard mouth openings have a circumferential diameter of about 10.2 mm and a longitudinal diameter of about 12.4 mm. Some recent flutes include slightly smaller mouth openings having a circumferential diameter of about 9.8 mm and a longitudinal diameter of about 11.8 mm. As shown in FIG. 1, the head section of the flute may include a mouthpiece 20.

Flute 2 also includes a central bore 12, which extends longitudinally through the main section 4 and head section 6. The geometry of the central bore may vary. For example, a simple flute includes a cylindrical bore having a uniform diameter 14 of about 19 mm throughout its length as shown in FIG. 1. The central bore in a Boehm or modern flute is nearly cylindrical where the main section has a uniform diameter of about 19 mm and the bore in the head section has a slight taper which decreases from a diameter about 19 mm at distal end adjacent the main section to a diameter of about 17 mm at the proximal end of the head section. Classical flutes have uniform bore diameter in the head section and a tapered bore in the main section such that the bore diameter gradually increases from a proximal end adjacent the head section to the distal end.

Figure 2:
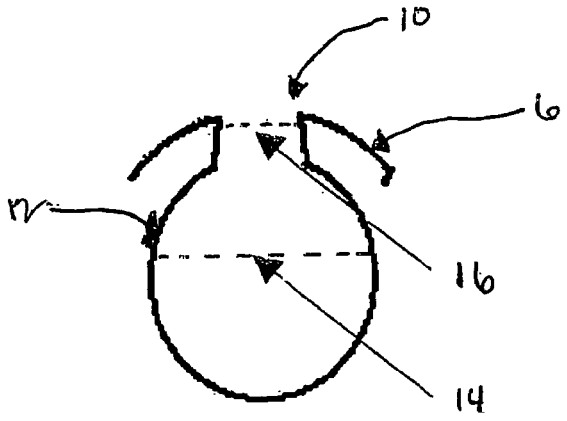
Prior Art FIG. 2
FIG. 2 is a cross-sectional view of the head section of a conventional flute instrument in the vicinity of the mouth opening taken along line 2—2 of FIG. 1.

FIG. 2 is a cross-sectional view of the head section of the flute shown in FIG. 1 taken in the vicinity of the mouth opening 8. As shown in FIG. 2, the diameter 14 of the portion of the central bore 12 in the head section is about twice the length of the circumferential diameter 16 of the mouth opening 10. Accordingly, the cross-sectional area of central bore 12 is about four times greater than the cross-sectional area of the mouth opening 10.

Figure 3:
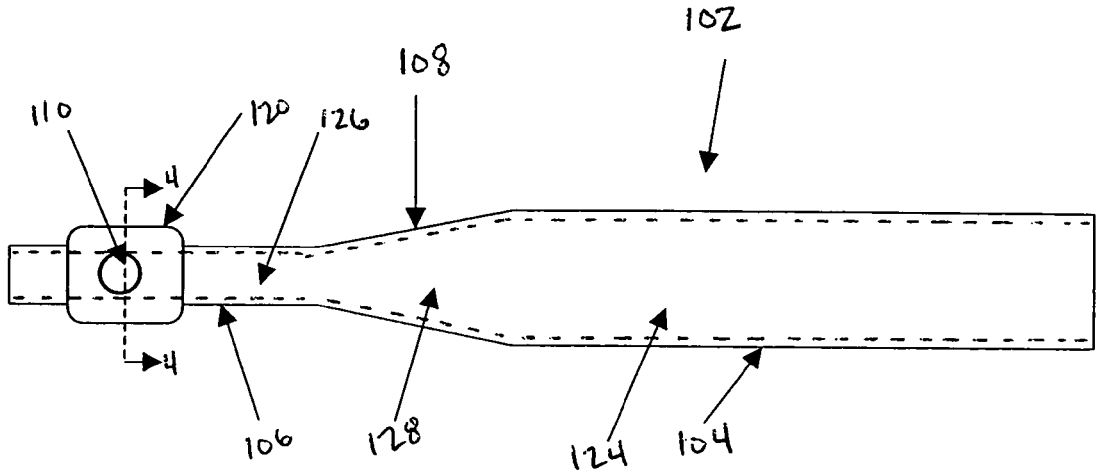
FIG. 3 is a perspective view of an embodiment of the present invention.
Figure 4:
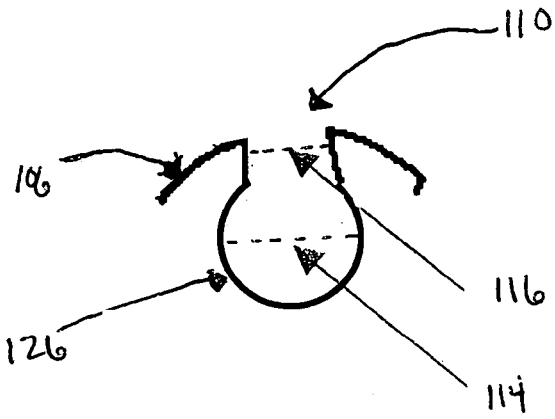
FIG. 4 is a cross-sectional view of an embodiment of the present invention taken along line 4—4 of FIG. 3.

FIGS. 3 and 4 illustrate an embodiment of a flute-type wind instrument utilizing features of the present invention. The present invention is not limited to the embodiment shown in FIGS. 3 and 4, and can be used with any wind instrument consisting of a head section having an internal bore and a side hole mouth opening. As shown in FIG. 3, flute-type instrument 102 includes a main section 104, a head section 106 and an intermediate section 108. Main section 104, head section 106 and intermediate section 108 each include a bore extending longitudinally therethrough which together form a continuous internal passage extending longitudinally through instrument 102.

In the embodiment illustrated in FIG. 3, main section 104 and head section 106 include cylindrical bores 124 and 126, respectively, having uniform diameters. Cylindrical bore 124 has a smaller diameter than cylindrical bore 126. Bore 128 formed in intermediate section 108 is tapered or conical in shape. The end of intermediate section 108 that interfaces with main section 104 has a bore diameter equal to the diameter of bore 124. Similarly, the opposite end of intermediate section 108 that interfaces with head section 106 has a smaller bore diameter equal to the diameter of bore 126.

The head section includes a mouth opening 110, which communicates with the internal passage via bore 126. The mouth opening is oval or elliptical in shape having a circumferential diameter 116. It is understood that the mouth opening may alternatively be circular in shape having a uniform diameter. The head section 106 may also include a mouthpiece 120, which includes an opening dimensioned to correspond to mouth opening 110.

Referring now to FIG. 4, a cross section of an embodiment of the present invention is shown in the vicinity of the mouth opening 110. As illustrated in FIG. 4, the embodiment of the present invention includes a reduced bore diameter in the head section. Specifically, the diameter of bore 126 is reduced such that the ratio of the diameter 114 of bore 126 and the circumferential diameter 116 of mouth opening 110 is about 1.5 to 1 or less. It will be understood that by reducing the diameter 114 of bore 126 relative to the diameter 116 of the mouth opening, the air stream passing through mouth opening 110 and into bore 126 does not undergo as much expansion as in the conventional flute-type instrument shown in FIGS. 1 and 2. Accordingly, the airstream will maintain a more laminar-like flow and reduce the degradation of tone quality resulting from the "hissing sound" effect.

As shown in FIG. 3, the diameter of the internal passage gradually increases in the intermediate section 108 from the reduced diameter of bore 126 in head section 106 to the maximum diameter of bore 124 in main section 104. Preferably, main section 104 has a maximum uniform bore diameter which allows optimum intonation of the upper octaves. For example, it is generally understood that the optimal bore diameter in the main section of a flute is about 19.0 mm.

It should be understood that the above description is only representative of illustrative examples of embodiments. For the reader's convenience, the above description has focused one of the possible embodiments for the purpose of teaching the principles of the invention. Other embodiments may result from different combinations of the various aspects of the invention. The description has not attempted to exhaustively enumerate all possible variations.

Furthermore, since numerous modifications and variations will readily occur to those skilled in the art, it is not desired that the present invention be limited to the exact construction and operation illustrated. Accordingly, all suitable modifications and equivalents that may be resorted to are intended to fall within the scope of the claims.

What is claimed is:

1. A wind instrument, comprising:

a head section having a proximal end, a distal end, a side surface and a bore extending therethrough;

a mouth opening formed in the side surface of the head section, the mouth opening communicating with the head section bore and having a circumferential diameter, wherein the ratio of the head section bore diameter in the vicinity of the mouth opening and the mouth opening circumferential diameter is about 1.5 to 1 or less;

a main section having a proximal end, a distal end, a bore extending therethrough and a plurality of toncholes communicating with the main section bore, wherein the main section bore diameter at the proximal end of the main section is greater than the head section bore diameter at the distal end of the head section; and an intermediate section having a proximal end, a distal end and a bore extending therethrough, the intermediate section bore having a first diameter at its proximal end substantially equal to the head section bore diameter at the distal end of the head section, a second diameter at its distal end substantially equal to the main section bore at the proximal end of the main section and a gradually increasing diameter extending from the proximal end to the distal end, whereby the proximal end of the intermediate section is coupled to the distal end of the head section and the distal end of the intermediate section is coupled to the proximal end of the main section, such that the head section bore, intermediate section bore and main section bore are coupled in flow communication.

2. The wind instrument of claim 1, wherein the intermediate section bore is conical.

3. The wind instrument of claim 1, wherein the head section bore and main section bore are cylindrical bores, each having a uniform diameter throughout its length.

4. The wind instrument of claim 3, wherein the bead section bore, main section bore and intermediate section bore are concentrically aligned and centrally disposed within the wind instrument.

5. The wind instrument of claim 1, wherein the ratio of the head section cylindrical bore diameter in the vicinity of the mouth opening and the mouth opening circumferential diameter is about 1 to 1.

6. The wind instrument of claim 1, wherein the head section and main section are tubular and the intermediate section is conical.

7. The wind instrument of claim 1, wherein the instrument is a flute and the main section bore is a cylindrical bore having a uniform diameter of about 19 mm.

8. A wind instrument, comprising:

a head section having a proximal end, a distal end, a side surface and a cylindrical bore extending therethrough and having a uniform diameter throughout its length;

a mouth opening formed in the side surface of the head section, the mouth opening communicating with the cylindrical bore and having a circumferential diameter, wherein the ratio of the head section cylindrical bore diameter and the circumferential diameter of the mouth opening is about 1.5 to 1 or less;

a main section having a proximal end, a distal end, a cylindrical bore extending therethrough and having a uniform diameter throughout its length and a plurality of toneholes communicating with the main section bore, wherein the diameter of the main section cylindrical bore is greater than the diameter of the head section cylindrical bore; and an intermediate section having a proximal end, a distal end and a bore extending therethrough, the intermediate section bore having a first diameter at its proximal end substantially equal to the diameter of the head section bore, a second diameter at its distal end substantially equal to the diameter of the main section bore and a gradually increasing diameter extending from the proximal end to the distal end, whereby the proximal end of the intermediate section is coupled to the distal end of the head section and the distal end of the intermediate section is coupled to the proximal end of the main section, such that the head section cylindrical bore, intermediate section bore and main section cylindrical are coupled in flow communication.

9. The wind instrument of claim 8, wherein the intermediate section bore is conical.

10. The wind instrument of claim 8, wherein the head section cylindrical bore, main section cylindrical bore and intermediate section bore are concentrically aligned and centrally disposed within the wind instrument.

11. The wind instrument of claim 8, wherein the ratio of the head section cylindrical bore diameter and the mouth opening circumferential diameter is about 1 to 1.

12. The wind instrument of claim 8, wherein the head section and main section are tubular and the intermediate section is conical.

13. The wind instrument of claim 8, wherein the uniform diameter of the main section bore is about 19 mm.

* * * * *

UNITED STATES PATENT AND TRADEMARK OFFICE

CERTIFICATE OF CORRECTION

PATENT NO. : 7,112,734 B2
APPLICATION NO. : 10/809620
DATED : September 26, 2006
INVENTOR(S) : Jacob Richter It is certified that error appears in the above-identified patent and that said Letters Patent is hereby corrected as shown below:

Title page, item [30] "Related U.S. Application Data" should read as follows:

--Provisional application No.: 60/457,081, filed on March 24, 2003.--.

Column 3, line 65 for the claim reference numeral "1", "toncholes" should read

--toneholes--.

Column 4, line 24 for the claim reference numeral "4", "bead" should read --head--.

Signed and Sealed this

Sixteenth Day of December, 2008

JON W. DUDAS
*Director of the United States Patent and Trademark Office*